US008312675B2

(12) United States Patent
Thiele

(10) Patent No.: US 8,312,675 B2
(45) Date of Patent: Nov. 20, 2012

(54) PINCH SENSOR FOR SLIDING DOOR

(75) Inventor: Steven R. Thiele, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 897 days.

(21) Appl. No.: 12/125,408

(22) Filed: May 22, 2008

(65) Prior Publication Data

US 2009/0289469 A1 Nov. 26, 2009

(51) Int. Cl.
*E05F 15/02* (2006.01)

(52) U.S. Cl. ... 49/27; 491/490.1; 491/498.1; 491/496.1; 491/492.1

(58) Field of Classification Search ..... 49/26, 27, 49/28, 490.1, 498.1, 360, 495.1, 492.1, 496.1, 49/475.1; 200/61.43
See application file for complete search history.

(56) References Cited

U.S. PATENT DOCUMENTS

| | | | | |
|---|---|---|---|---|
| 5,038,521 | A * | 8/1991 | Andrzejewski et al. | 49/441 |
| 5,592,060 | A * | 1/1997 | Racine et al. | 318/469 |
| 6,339,305 | B1 * | 1/2002 | Ishihara et al. | 318/445 |
| 6,389,752 | B1 * | 5/2002 | Rosenau | 49/28 |
| 6,820,372 | B2 * | 11/2004 | Nozaki | 49/498.1 |
| 6,896,268 | B2 * | 5/2005 | Hofmann et al. | 277/317 |
| 6,955,079 | B2 | 10/2005 | Ishihara et al. | |
| 7,000,352 | B2 * | 2/2006 | Ishihara et al. | 49/28 |
| 7,015,666 | B2 * | 3/2006 | Staus | 318/286 |
| 7,083,222 | B2 * | 8/2006 | Oda et al. | 296/146.9 |
| 7,893,831 | B2 * | 2/2011 | Hoshina et al. | 340/545.1 |
| 2005/0155292 | A1 * | 7/2005 | Cittadini et al. | 49/490.1 |
| 2007/0101656 | A1 * | 5/2007 | Stipp | 49/490.1 |
| 2009/0267786 | A1 * | 10/2009 | Sakamaki et al. | 340/686.6 |

FOREIGN PATENT DOCUMENTS

| | | | |
|---|---|---|---|
| JP | 2005-075085 | A | 3/2005 |
| JP | 2006-131144 | A | 5/2006 |
| JP | 2007-176322 | A | 7/2007 |
| JP | 2007-186110 | A | 7/2007 |

* cited by examiner

*Primary Examiner* — Jerry Redman
(74) *Attorney, Agent, or Firm* — Clifford B. Vaterlaus, Esq.; Emerson Thomson Bennett

(57) ABSTRACT

A pressure-activated sensor assembly may include a switch component that actuates upon pressure contact with an obstructing object; a flexible component that substantially surrounds and encases the switch component; an engagement component that engages a projection of an associated closure component; an extended portion disposed substantially on a side of the engagement component that contacts a side surface of the associated closure component; and at least one fastener that secures the extended portion to the side surface of the closure component.

20 Claims, 3 Drawing Sheets

PINCH SENSOR FOR SLIDING DOOR

I. BACKGROUND OF THE INVENTION

A. Field of Invention

This invention generally relates to methods and apparatus concerning safety sensors installed in vehicles. More specifically, the present invention relates to methods and apparatuses concerning pressure-activated sensors for preventing an automatic door or other moveable structure in a passenger vehicle from forcibly closing in the event the opening becomes obstructed by, for example, the arms, legs, or fingers of a passenger.

B. Description of the Related Art

Pressure-activated sensors are used in passenger vehicles and in other applications for use in preventing an automatic powered door from forcibly closing over an obstruction, such as the arms, legs, or fingers of a passenger. In automotive applications, such sensors (typically referred to as "pinch sensors") are required for customer protection when vehicles include a slide door.

In a known construction, illustrated in FIG. 1, a pinch sensor 10 is affixed to a metal bracket 12 that extends from the slide door. The pinch sensor 10 of this type has a complicated, expensive design requiring a number of screws or other fasteners to secure it to the door. It also has a "tacked on" appearance and does not appear to be an integrated component of the door.

In order to overcome these difficulties, a pinch sensor design is needed that simplifies installation and requires fewer parts while providing a streamlined, integrated appearance.

II. SUMMARY OF THE INVENTION

Some embodiments of the present invention relate to a pressure-activated sensor assembly including a switch component that actuates upon pressure contact with an obstructing object. A flexible component is provided that substantially surrounds and encases the switch component. An engagement component engages a projection of a closure component. An extended portion is disposed substantially on a side of the engagement component that contacts a side surface of the closure component. One or more fasteners are provided that secure the extended portion to the side surface of the closure component.

Other embodiments of the present invention relate to an automated door assembly including a motorized door component that is movable between an open position and a closed position. A door frame engages the motorized door component when in the closed position. A pressure-activated sensor assembly is provided that disengages the motorized door component upon contact with an obstructing object. The pressure-activated sensor includes a switch component that actuates upon pressure contact with the obstructing object. A flexible component is provided that substantially surrounds and encases the switch component. An engagement component engages a projection of the motorized door component. An extended portion is disposed substantially on a side of the engagement component that contacts a side surface of the motorized door component. One or more fasteners are provided that secure the extended portion to the side surface of the motorized door component.

Still other embodiments of the present invention relate to a method of making a motorized door having a pressure-activated sensor assembly. A motorized door component is provided that is movable between an open position and a closed position. A door frame is provided that engages the motorized door component when in the closed position. A pressure-activated sensor assembly is affixed to the motorized door component to disengage the motorized door component upon contact with an obstructing object. This step of affixing includes a sub-step of forming a flexible component that substantially surrounds and encases a switch component that actuates upon pressure contact with the obstructing object. The affixing also includes engaging an engagement component onto a projection of the motorized door component. Also included in the affixing is the sub-step of contacting an extended portion disposed substantially on a side of the engagement component with a side surface of the motorized door component. Affixing also may entail the sub-step securing at least one fastener between the extended portion and the side surface of the motorized door component.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

The present invention generally relates to a pressure activated sensor and methods for making the same, so as to prevent an automated door from closing over an obstruction that might result in injury of a passenger or damage to an article or the door mechanism itself.

Figure 3:
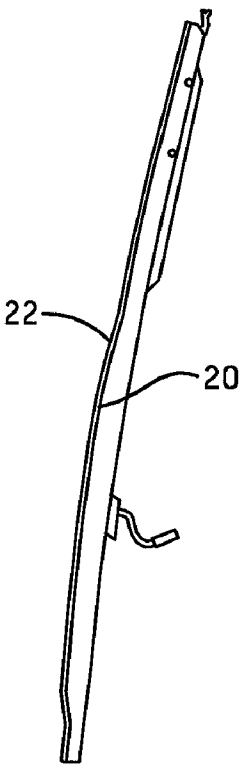
FIG. 3 is a side view showing the pressure activated sensor installed on a slide door of a vehicle, in accordance with the present invention.
Figure 1:
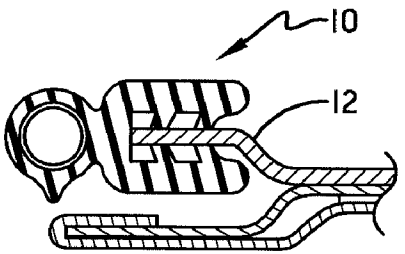
FIG.-1 PRIOR ART
FIG. 1 is a sectional view depicting a pinch sensor in accordance with a known design.
Figure 2:
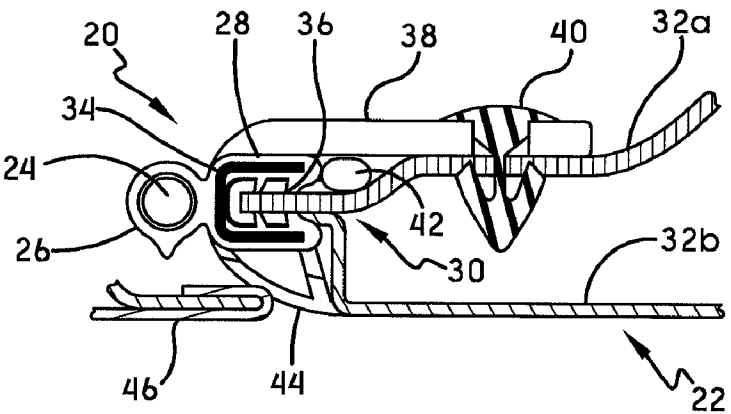
FIG. 2 is a sectional view illustrating a pressure activated sensor in accordance with the present invention.

We refer now to the drawings wherein the showings are for purposes of illustrating embodiments of the invention only and not for purposes of limiting the same, and wherein like reference numerals are understood to refer to like components. FIGS. 2 and 3 depict a pressure-activated sensor assembly 20 that is attached longitudinally to a side surface of a closure component 22. The closure component 22 may be any apparatus chosen with sound engineering judgment such as, for example, an edge of a slide door in a passenger vehicle. In one embodiment, the edge of the slide door is designed so as to have a hem that is configured to receive the sensor assembly 20.

The pressure activated sensor assembly 20 includes a switch component 24 that actuates upon pressure contact with an obstructing object. In one embodiment, shown in FIG. 3, the switch component 24 is an elongated switch component that extends substantially over a portion, including some or all of a contacting edge, of the closure component 22.

The switch component 24, in one embodiment, may be a multiple-strand arrangement of wires that are arranged so that contact of the sensor 24 by an obstruction (this contact may be considered "pinch contact") causes two or more wires to come into contact with each other, thereby establishing a current in an electrical circuit. Detection of this current may then be used to deactivate a motor that drives the closure component 22, thereby stopping the motion of the closure component 22. In this way, the motor is deactivated upon pinch contact of the pressure activated sensor 24 by the obstruction. It should be understood that this invention will work with switch components 24 of other designs as well.

A flexible component 26 that substantially surrounds and encases the switch component 24 may also be provided. As shown in FIG. 2, the flexible component 26 is fashioned so as to protrude in the direction of movement of the sensor 24 at the side surface of the closure component 22. In this way, the sensor 24 is disposed so as to efficiently engage an obstruction and thereby promote safety.

An engagement component 28 is provided that engages a projection 30 of a closure component 22. As shown in FIG. 2, the projection 30 can be a "hem edge" formed of a joint of sheet metal members 32*a*, 32*b* at the edge of a slide door. The engagement component 28 may be, in one embodiment, generally U-shaped having a pair of legs that are positioned on opposite sides of the projection 30, as shown. The engagement component 28 may, in another embodiment, include a metal core 34 to resist deformation and to hold the pressure activated sensor assembly 20 more securely to the projection 30. In yet another embodiment, the engagement component 28 may also include a plurality of deformable tabs 36 extending inwardly from the legs that form an interference engagement over the projection 30 of the closure component 22.

The sensor assembly 20 may also include an extended portion 38 disposed substantially one side of the engagement component 28, for use in contacting a side surface of the closure component 22. As illustrated in FIG. 2, the extended portion 38 contacts an interior sheet metal member 32*a* facing toward the interior of a cabin section of a passenger vehicle. One or more fasteners 40 may be used to secure the extended portion 38 to the side surface of the closure component 22. For the embodiment shown, the fastener 40 attaches the extended portion 38 to the interior sheet metal member 32*a*.

For the embodiment shown, the fastener 40 includes a plurality of deformable clips that extend through an aperture in the extended portion 38 and a corresponding aperture in the side surface of the closure component 22. The deformable clips may be formed, in one embodiment, of a sturdy polymer material such as nylon or the like. The design of the present invention thereby eliminates the metal bracket and holding screws used in previous-type sensor designs.

For the embodiment illustrated in FIG. 2, the extended portion 38 and the side of the engagement component 32*a* define a cavity for receiving and retaining a cord 42 for a harness connection. It is to be appreciated that the cord 42 runs longitudinally in the direction of the sensor assembly 20 as generally indicated in FIG. 3. By incorporating the cavity into the sensor assembly 20, the harness cord 42 can be restrained without requiring the addition of pads and tape such as in previous designs, thereby improving efficiency and reducing parts and installation steps.

Figure 5:
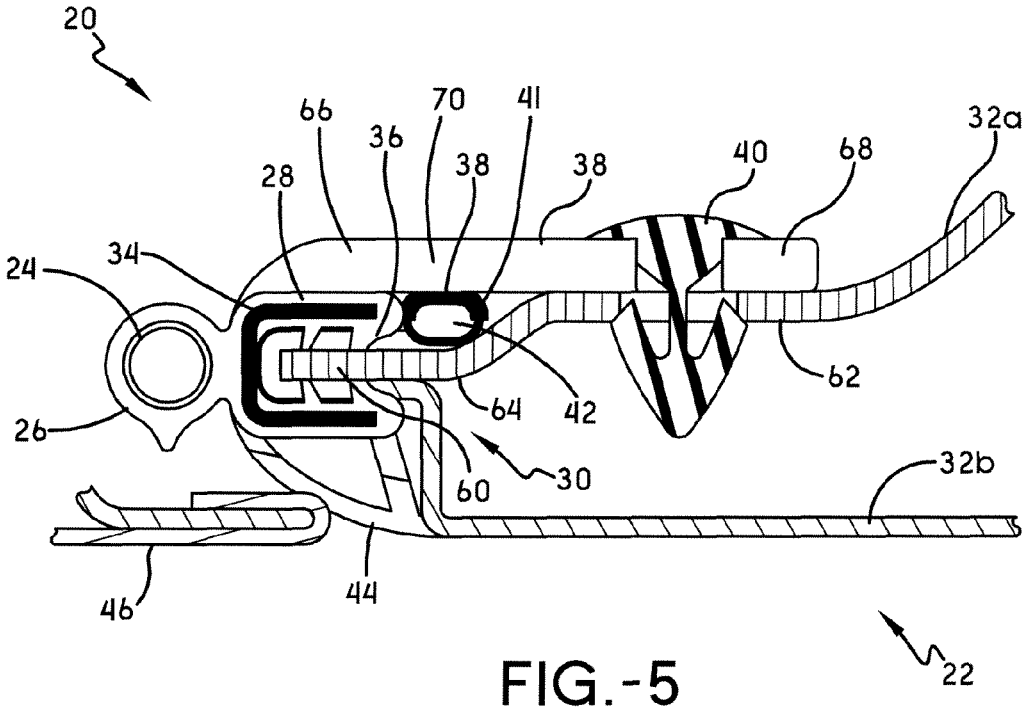
FIG. 5 is a sectional view illustrating a pressure activated sensor according to another embodiment of the present invention.

For the embodiment illustrated in FIG. 5, interior sheet metal member 32*a* is S-shaped having a first arm 60 off-set from a second arm 62 by a mid-section 64. A holder portion 41 is positioned within the cavity defined by the extended portion 38 and the side of the engagement component 32*a*. As shown, the extended portion 38 has a first end 66, a second end 68, and a mid-section 70 positioned between the first and second ends. In one embodiment, the holder portion 41 is fixedly attached to the extended portion 38. The holder portion 41 may be sized to receive the cord 42. In one specific embodiment, the holder portion 41 is in a general C-shape. The holder portion 41 may extend longitudinally in the direction of the sensor assembly 20 as generally indicated in FIG. 3. The holder portion 41 may restrain the harness cord 42 without requiring the addition of pads and tape such as in previous designs, thereby improving efficiency and reducing parts and installation steps.

In one embodiment, the sensor assembly 20 also includes a seal component 44 that forms a sealing engagement between the closure component 22 and a frame 46. The frame 46 can include a suitable frame portion of a passenger vehicle in embodiments where the closure component 22 is a slide door for a passenger vehicle. The seal component 44 may be disposed on an opposite side of the engagement component 28 from the extended portion 38. As illustrated in FIG. 2, the seal component 44 contacts an exterior sheet metal member 32*b* facing toward the exterior of the passenger vehicle. The seal component 44 provides a gap seal to reduce wind noise.

In another embodiment, the flexible component 26, the engagement component 28, and the extended portion 38 are all formed integrally as a single component. For embodiments that also include the seal component 44, the seal component 44 can also be formed integrally as a single component with the flexible component 26, the engagement component 28, and the extended portion 38. In another embodiment, the holder portion 41, the flexible component 26, the engagement component 28, and the extended portion 38 are formed integrally as a single component. In yet another embodiment, the holder portion 41, the flexible component 26, the engagement component 28, the extended portion 38, and the seal component 44 are formed integrally as a single component. In a more specific embodiment, the single component can be molded of a flexible polymer material using a molding process, as is known in the art.

The pressure activated sensor assembly 20 of the present invention, as disclosed hereinabove, may be a component in an automated door assembly. The closure component 22 may be a motorized door component that is movable between an open position and a closed position. The frame 46 may be a door frame that engages the motorized door component when in the closed position. The motorized door component and the door frame may be incorporated into a passenger vehicle. The pressure activated sensor assembly 20, as disclosed hereinabove, can be used to deactivate the motorized door component upon contact with an obstructing object.

In yet another embodiment, the pressure activated sensor assembly 20 and its associated components (such as the switch component 24) are elongated components that extend substantially over a portion of a contacting edge of the motorized door component, where the portion can include some or all of the contacting edge. The deformable tabs 36 may be used to form an interference engagement over the projection 30 formed of the sheet metal members 32*a*, 32*b* that form the motorized door component. The seal component 44 may be used to form a sealing engagement between the motorized door component and the door frame.

Figure 4:
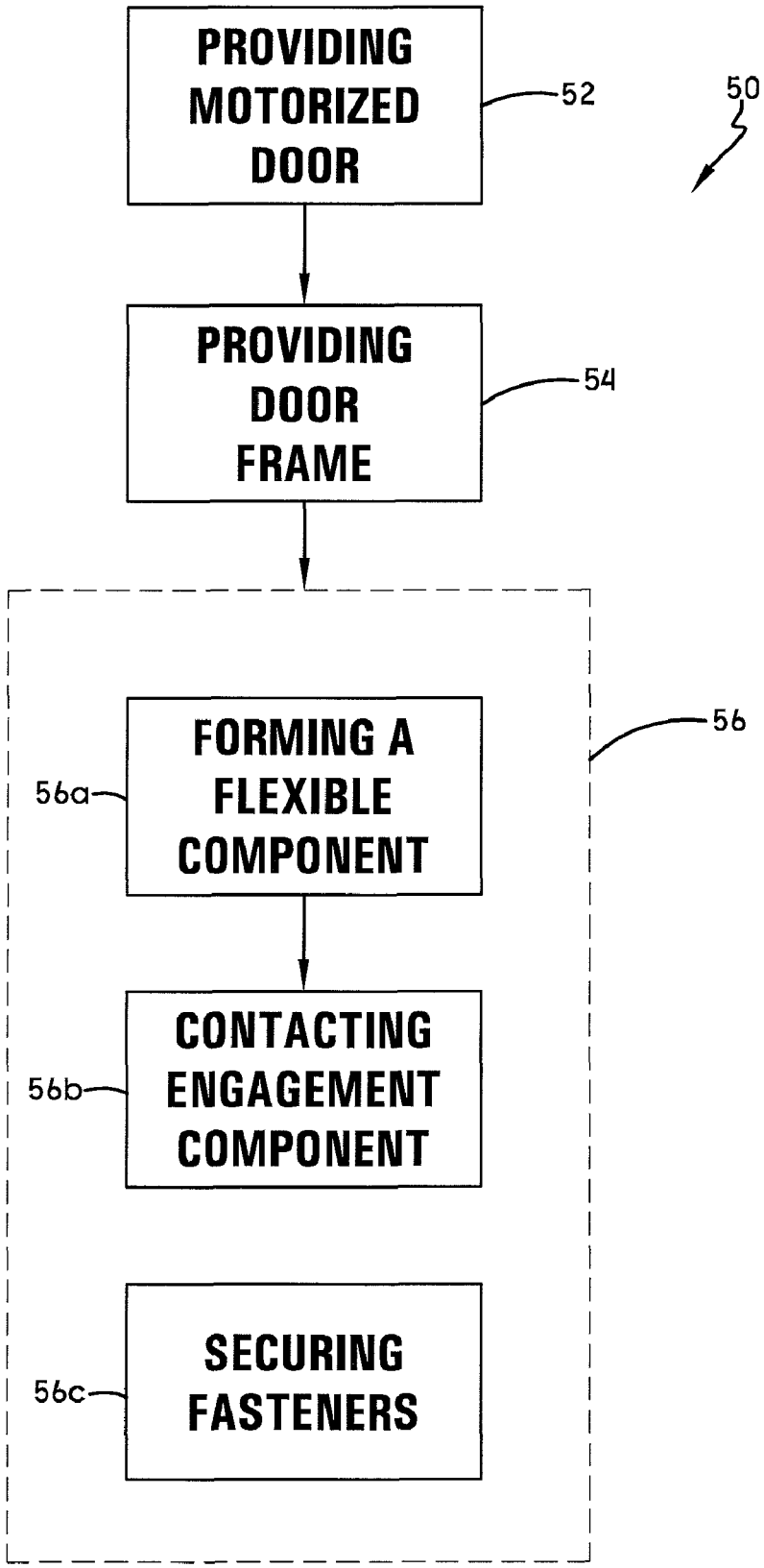
FIG. 4 is a flow chart depicting a method of making a pressure activated sensor in accordance with the present invention.

FIG. 4 is a flow chart depicting a method 50 of making a motorized door having a pressure-activated sensor. A step 52 is performed of providing a motorized door component movable between an open position and a closed position. A step 54 is also performed of providing a door frame that engages the motorized door component when in the closed position. A step 56 is performed of affixing a pressure-activated sensor to the motorized door component to disengage the motorized door component upon contact with an obstructing object.

This step 56 includes a substep 56*a* of forming a flexible component that substantially surrounds and encases a switch component that actuates upon pressure contact with the obstructing object. A substep 56*b* is performed of engaging an engagement component onto a projection of the motorized door component. A substep 56*c* is performed of contacting an extended portion disposed substantially on a side of the engagement component with a side surface of the motorized door component. Finally, a substep 56*c* is performed of securing one or more fasteners between the extended portion and the side surface of the motorized door component.

Multiple embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof.

I claim:

1. An automated door assembly comprising:

a motorized door component that is movable between an open position and a closed position, the motorized door component comprising an interior sheet member and an exterior sheet member, wherein the interior sheet member is S-shaped having a first arm off-set from a second arm by a mid-section, wherein the first arm of the interior sheet member and the exterior sheet member meet to define a projection;

a door frame that engages the motorized door component when the motorized door component is in the closed position;

a cord for a harness connection; and, a pressure-activated sensor assembly that disengages the motorized door component upon contact with an obstructing object, the pressure-activated sensor assembly comprising:

(a) a switch component that actuates upon pressure contact with the obstructing object;

(b) a flexible component that substantially surrounds and encases the switch component;

(c) an engagement component that engages the projection;

(d) an extended portion having a first end, a second end, and a mid-section positioned between the first and second ends, wherein the first end of the extended portion is attached to a side of the engagement component and the second end of the extended portion abuts the second arm of the interior sheet member;

(e) wherein the mid-section of the interior sheet member and the mid-section of the extended portion define a cavity that receives the cord; and, (f) at least one fastener that secures the second end of the extended portion to the second arm of the interior sheet member.

2. The automated door assembly of claim 1 further comprising:

a holder portion that is positioned within the cavity and that receives and supports the cord.

3. The automated door assembly of claim 2 wherein the holder portion:

is fixedly attached to the mid-section of the extended portion; and, is substantially C-shaped.

4. The automated door assembly of claim 2, wherein the flexible component, the engagement component, the extended portion, and the holder portion are formed integrally as a single component.

5. The automated door assembly of claim 1, further comprising:

a seal component that forms a sealing engagement between the motorized door component and the door frame.

6. The automated door assembly of claim 5, wherein the seal component is disposed on an opposite side of the engagement component from the extended portion.

7. The automated door assembly of claim 1, wherein the at least one fastener is a separate piece from the extended portion and comprises a plurality of deformable clips that extend through an aperture in the extended portion and an aperture in the second arm of the interior sheet member.

8. The automated door assembly of claim 1, wherein the motorized door component and the door frame are incorporated into a passenger vehicle.

9. The automated door assembly of claim 1, wherein the engagement component comprises a metal core and a plurality of deformable tabs that form an interference engagement over the projection.

10. A pressure-activated sensor assembly for attachment to an associated closure component comprising an interior sheet member, an exterior sheet member and, a cord for a harness connection, wherein the interior sheet member is S-shaped having a first arm off-set from a second arm by a mid-section, wherein the first arm of the interior sheet member and the exterior sheet member meet to define a projection, the pressure-activated sensor assembly comprising:

a switch component that actuates upon pressure contact with an obstructing object;

a flexible component that substantially surrounds and encases the switch component;

an engagement component that engages the projection;

an extended portion having a first end, a second end, and a mid-section positioned between the first and second ends, wherein the first end of the extended portion is attached to a side of the engagement component and the second end of the extended portion abuts the second arm of the interior sheet member;

wherein the mid-section of the interior sheet member and the mid-section of the extended portion define a cavity that receives the cord; and, at least one fastener that secures the second end of the extended portion to the second arm of the interior sheet member.

11. The sensor assembly of claim 10 further comprising:

a holder portion that is positioned within the cavity and that receives and supports the cord.

12. The sensor assembly of claim 11 wherein the holder portion:

is fixedly attached to the mid-section of the extended portion; and, is substantially C-shaped.

13. The sensor assembly of claim 12, wherein the flexible component, the engagement component, the extended portion, and the holder portion are formed integrally as a single component.

14. The sensor assembly of claim 10, further comprising:

a seal component that forms a sealing engagement between the closure component and an associated frame.

15. The sensor assembly of claim 10, wherein the seal component is disposed on an opposite side of the engagement component from the extended portion.

16. The sensor assembly of claim 15, wherein the seal component, the flexible component, the engagement component, and the extended portion are formed integrally as a single component.

17. The sensor assembly of claim 10, wherein the at least one fastener is a separate piece from the extended portion and comprises a plurality of deformable clips that extend through an aperture in the extended portion and an aperture in the second arm of the interior sheet member.

18. The sensor assembly of claim 10, wherein the associated closure component is a motorized door for a passenger vehicle.

19. The sensor assembly of claim 10, wherein the engagement component comprises a metal core and a plurality of deformable tabs that form an interference engagement over the projection.

20. The sensor assembly of claim 10, wherein the switch component is an elongated switch component that extends substantially over at least a portion of a contacting edge of the associated closure component.

* * * * *